US006741324B1

(12) United States Patent
Kim

(10) Patent No.: US 6,741,324 B1
(45) Date of Patent: May 25, 2004

(54) LOW PROFILE COMBINATION EXIT AND EMERGENCY LIGHTING SYSTEM HAVING DOWNWARDLY SHINING LIGHTS

(76) Inventor: Il Kim, 13137 Casa Linda, #18D, Garden Grove, CA (US) 92844

( * ) Notice: Subject to any disclaimer, the term of this patent is extended or adjusted under 35 U.S.C. 154(b) by 0 days.

(21) Appl. No.: 10/225,671

(22) Filed: Aug. 21, 2002

(51) Int. Cl.[7] ..... F21V 21/00

(52) U.S. Cl. ..... 352/249; 362/250; 362/269; 362/285; 362/287

(58) Field of Search ..... 362/249, 250, 362/269, 270, 285, 287, 219, 371, 378, 555, 238, 247; 40/570

(56) References Cited

U.S. PATENT DOCUMENTS

| | | | | |
|---|---|---|---|---|
| 1,469,946 A | | 10/1923 | Morrison | |
| 2,213,584 A | | 9/1940 | Hulst | 240/37.1 |
| 5,025,355 A | | 6/1991 | Harwood | 362/147 |
| D379,373 S | | 5/1997 | Logan et al. | D20/10 |
| 5,797,673 A | | 8/1998 | Logan et al. | 362/234 |
| 5,964,051 A | | 10/1999 | Loeber et al. | 40/570 |
| 6,026,602 A | * | 2/2000 | Grondal et al. | 40/570 |
| 6,142,648 A | | 11/2000 | Logan et al. | 362/234 |
| D446,818 S | | 8/2001 | Kim | D20/10 |
| 6,280,042 B1 | * | 8/2001 | Wegrzyn et al. | 362/20 |
| 6,309,085 B1 | * | 10/2001 | Katz et al. | 362/234 |
| 2001/0045035 A1 | | 11/2001 | Katz | 40/570 |

* cited by examiner

*Primary Examiner*—Sandra O'Shea
*Assistant Examiner*—Guiyoung Lee
(74) *Attorney, Agent, or Firm*—James G. O'Neill, Klein, O'Neill & Singh, LLP

(57) ABSTRACT

A low profile combination exit and emergency light system having a single piece body with a central internal chamber having a pair of spaced batteries connected to a LED lighting strip, and a pair of integral end portions with separate downwardly shining lights held therein. The system may be mounted from the top utilizing a special adapter and may include emergency lights mounted in special movable housings that pivot to allow a broad range of motion.

15 Claims, 5 Drawing Sheets

LOW PROFILE COMBINATION EXIT AND EMERGENCY LIGHTING SYSTEM HAVING DOWNWARDLY SHINING LIGHTS

BACKGROUND OF THE INVENTION

1. Field of the Invention

This invention generally relates to combination exit and emergency light systems and, more particularly, to an improved low profile combination exit and emergency light system having a single piece body with downwardly shining lights therein.

2. Description of the Prior Art

Emergency and exit lights are mandated by building codes everywhere for commercial and other types of buildings. These lights take many forms, including separate and distinct exit signs to indicate the safest exits, and emergency lights to provide ambient lighting. Additionally, combination exit and emergency lights referred to as "combo" units are known. These "combo" units come in many forms, and have been used for many years. Examples of such combo units are shown in U.S. Pat. Nos. 2,213,584 to Hulst, 5,797,673 to Logan et al. and 6,142,648 to Logan et al. These combo units include circuitry and a power source, such as a single tall battery held in the interior to power the separate exit and emergency lights during loss of AC power from the AC mains. Furthermore, these combo units are usually placed above doorways to indicate exits from buildings and/or rooms during emergency conditions and provide ambient lighting. However, in some situations, such as during fires or similar situations where hazy or smoky conditions occur, it is difficult to see the exit signs and the emergency lights do not provide sufficient light to pierce the haze or smoke. If the lighting is not sufficient, persons can become confused and disoriented. Therefore, there exists a need in the art for a combination exit and emergency light having downwardly pointing or shining lights so as to penetrate haze and smoke and light a doorway more clearly during an emergency.

Furthermore, the known combination exit and emergency lighting systems have numerous drawbacks or problems, including, but not limited to, cost to produce, size and weight. Such known combination exit and emergency lighting systems use incandescent lighting, a single heavy battery source located centrally in an internal chamber, and requires tension supports in the interior for the battery and movable/removable emergency lighting portions.

With the current global concerns over environmental and safety issues, as well as the need to cut down on waste and to save energy, a combination exit and emergency lighting system that is lighter in weight, smaller in overall dimensions (i.e., has a low profile), a single piece housing and a pair of spaced apart smaller batteries offers a simple and elegant solution to known problems and obviates many concerns.

Therefore, there exists a need in the art for a low profile, lighter weight combination exit and emergency lighting system, which overcomes many of the known problems, contains downwardly shining lights, and which can be expeditiously manufactured in accordance with the present invention.

SUMMARY OF THE INVENTION

Accordingly, it is a general object of the present invention to provide an improved combination exit and emergency lighting system. It is a more particular object of the present invention to provide an improved combination exit and emergency lighting system having downwardly shining lights held therein. It is a further object of the present invention to provide an improved combination exit and emergency lighting system having a single piece body holding the exit sign, emergency lights and downwardly shining lights. It is yet another object of the present invention to provide an improved combination exit and emergency lighting system of the cantilevered type not requiring tensioned supports. It is a still further object of the present invention to provide a novel and improved combination exit and emergency lighting system utilizing a single strip LED and a pair of spaced apart batteries held in an integral housing. It is yet a still further object of the present invention to provide an improved combination exit and emergency lighting system having a single piece housing that may be mounted from the back, top or sides utilizing a special adapter that minimizes the leakage of light there from, and which includes emergency lights having a range of motion controlled by a unique mounting means.

In accordance with one aspect of the present invention there is provided a low profile combination exit and emergency light system having a single piece body with a central internal chamber having a pair of spaced batteries connected to a single LED strip, and a pair of end portions with downwardly shining lights held therein. The system of the present invention may be mounted from the top utilizing a special mounting bracket and may include emergency lights mounted in special housings allowing a broad range of motion.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved low profile combination exit and emergency light system.

The low profile combo unit of the present invention has a narrower profile, i.e is thinner than known combo units for a number of reasons, including the fact that it utilizes a pair of spaced apart "smaller" batteries and a single LED strip having a selected number of lamps, for example, 15 lamps if for a red exit light and 7 lamps if for a green exit light. The low profile combo unit of the present invention accomplishes this while still providing a lighting system that includes an exit sign, a pair of emergency spot lights and a pair of downwardly shining lights held in fixedly attached or integral end portions of a an integral or single piece housing. The present invention accomplishes the above while eliminating the need for ladder-type tensioning means and reducing the amount of heat produced by the unit, thereby allowing a thinner housing having thinner side walls to be used, and eliminating or reducing the amount of light leakage from connecting openings in known combo units.

Figure 6:
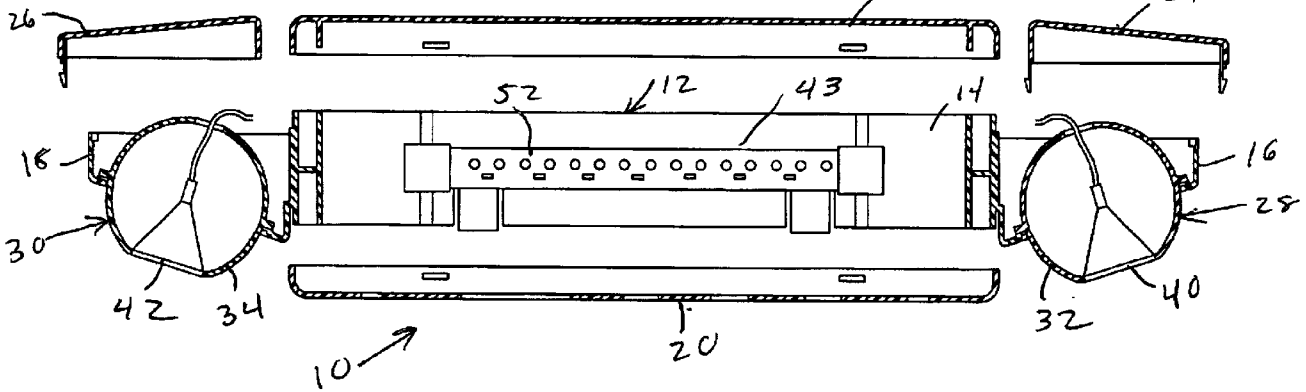
FIG. 6 is a cross sectional view taken along line 6—6 of FIG. 5 and including the front plate of FIG. 4.

Turning now to the drawings, FIGS. 1–6 show a first embodiment of an improved and novel low profile combination exit and emergency light system 10, generally indicated at 10. The low profile combination exit and emergency light system 10 ("combo unit") has an integral or single piece main body or housing 12, which includes a hollow central portion 14 and two integral or permanently secured end portions 16, 18, formed in any desired manner from any available material, but preferably molded from plastic material of sufficient strength to support all the desired elements therein. The central portion 14 of combo unit 10 includes a removable front or face plate 20 having indicia formed therein, in a manner well known to those skilled in the art, such as the letters to form the lighted word EXIT and direction indicators or chevrons, which chevrons may be selectively blocked or opened, depending on how the combo unit is mounted. A rear or back plate 22 is also removably secured to the central portion 14. The rear plate 22 is preferably solid, except if the combo unit 10 is to be mounted flush to a wall, and may include indicia if the combo unit is otherwise mounted, as from above. Additionally, the integral or permanently attached end portions 16, 18 include removable rear or back plates 24, 26 and emergency lighting units 28, 30 in or on the front surface thereof. The emergency lighting units 28, 30 may take any desired shape or form, and are preferably movable in a number of directions so as to be capable of being aimed in a desired direction, away for the central portion 14. As best shown in FIG. 6 the first embodiment of the emergency lighting units 28, 30 include substantially circular rotatable housings 32, 34 having guiding elements or strips 36, 38 formed thereon and having lamps or spotlights 40, 42 held therein. The guiding strips 36, 38 are preferably held in openings or slots formed in the end portions 16, 18 or in separate rotatable elements held therein.

The central portion 14 includes a hollow internal chamber or interior 43 having a pair of batteries 44, 46, a transformer 48, a number of circuit boards 50, an LED lighting strip 52 and various other required elements and electrical connections to control the lighting of the exit sign (via the LED strip) and emergency lighting units 28, 30.

Figure 3:
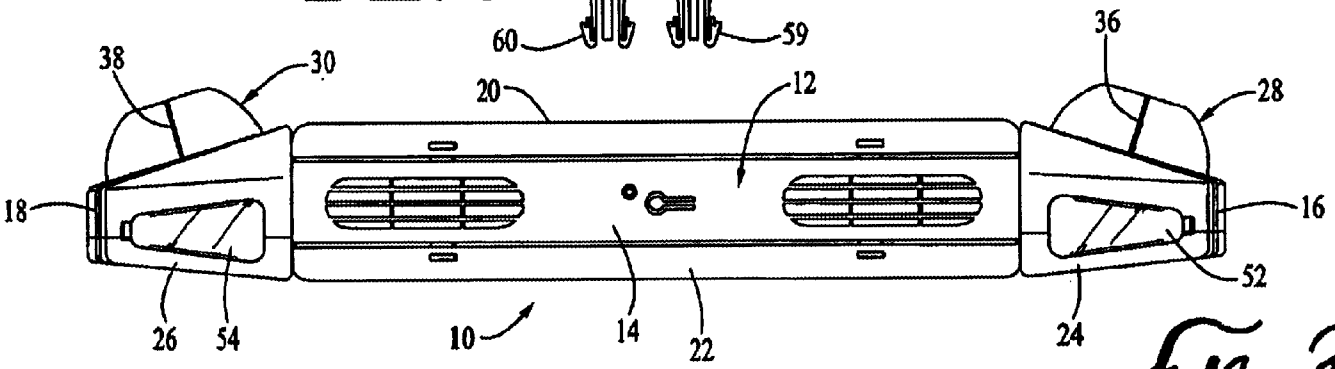
FIG. 3 is a bottom plan view of FIG. 1.
Figure 5:
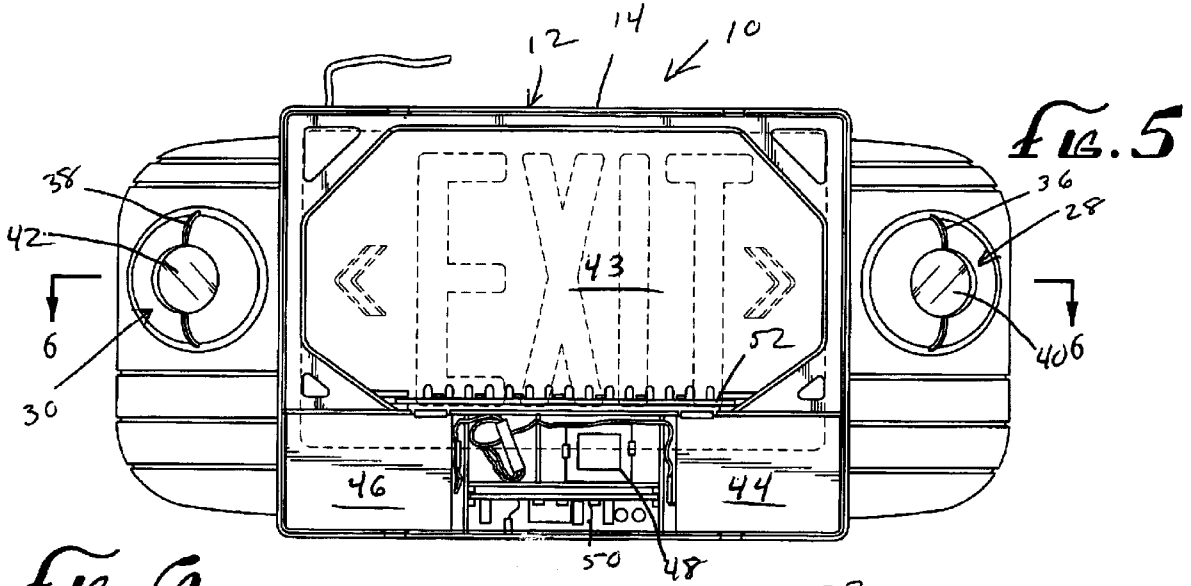
FIG. 5 is a front elevational view of the combo light system shown in FIG. 4, looking in the direction of arrows 5—5, with the exit sign portion shown in phantom.

In addition, as best shown in FIG. 3, the integral end portions 16, 18 include downwardly pointing or shining fixed lights 52, 54, also powered by the batteries 44, 46 held in the hollow interior 43. These lights 52, 54 may take any form, but are shown as including lenses covering bulbs or LEDs that are intense or powerful enough that when they shine downwardly from the combo unit 10 mounted above a doorway, the light there from will shine through haze or smoke onto the doorway. This enables a person or persons moving under such smoke or haze while bent over or crawling, to see the exit to aid them in escaping.

Figures 1, 2:
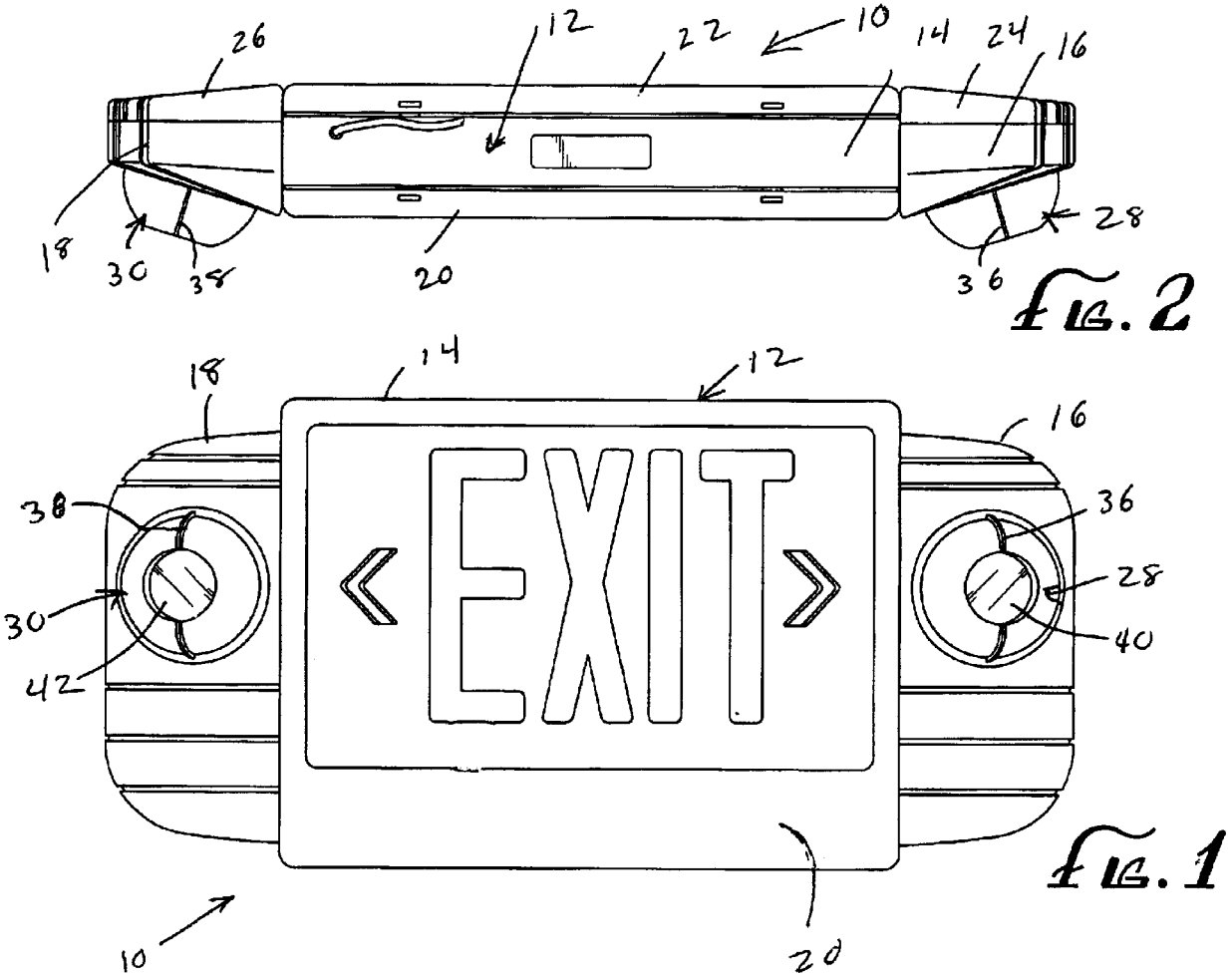
FIG. 1 is a front elevational view of a first embodiment of a low profile combination exit and emergency light system having a single piece body of the present invention.
FIG. 2 is a top plan view of FIG. 1.
Figure 4:
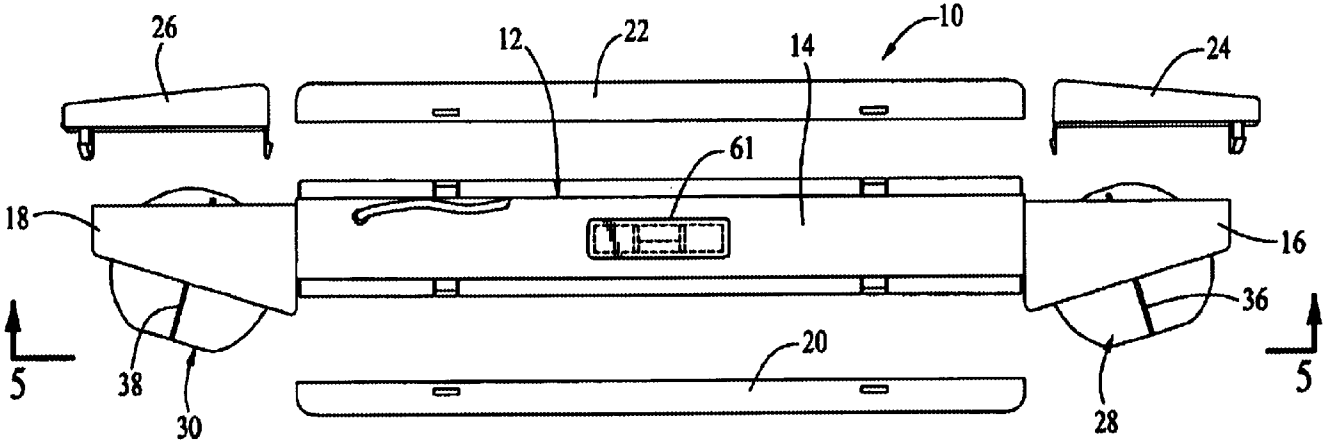
FIG. 4 is an exploded top view of FIG. 1 showing the single piece main body or housing and the front and back cover plates.
Figure 7:
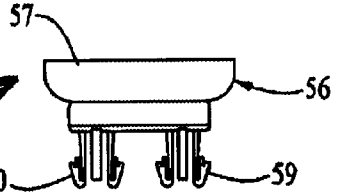
FIG. 7 is a front elevational view of a connecting portion for use with the combo light system of the present invention.
Figure 9:
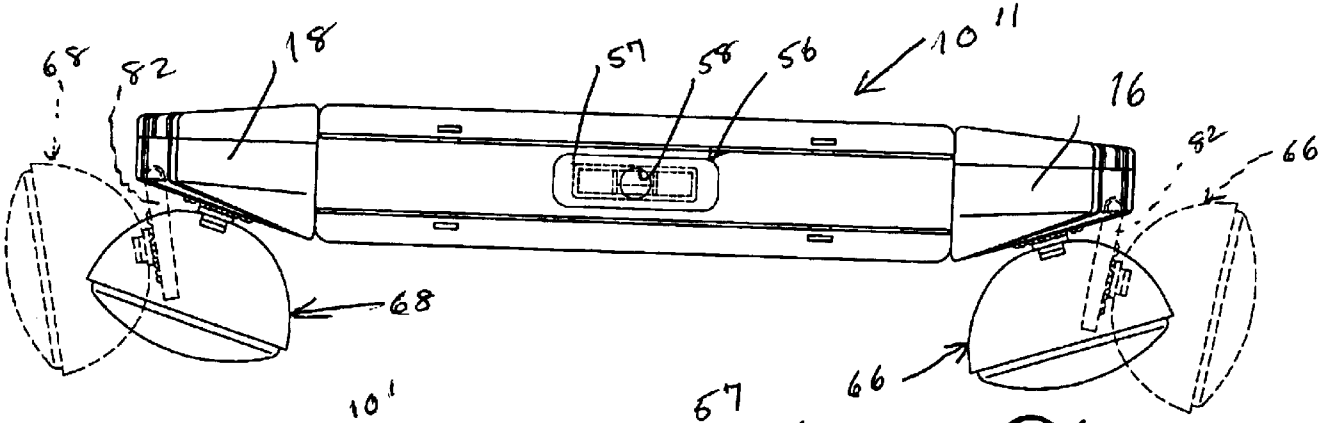
FIG. 9 is a top plan view of third embodiment of a low profile combination exit and emergency light system, having the connecting bracket held therein and cylindrical emergency lights held in special movable holding portions.
Figure 8:
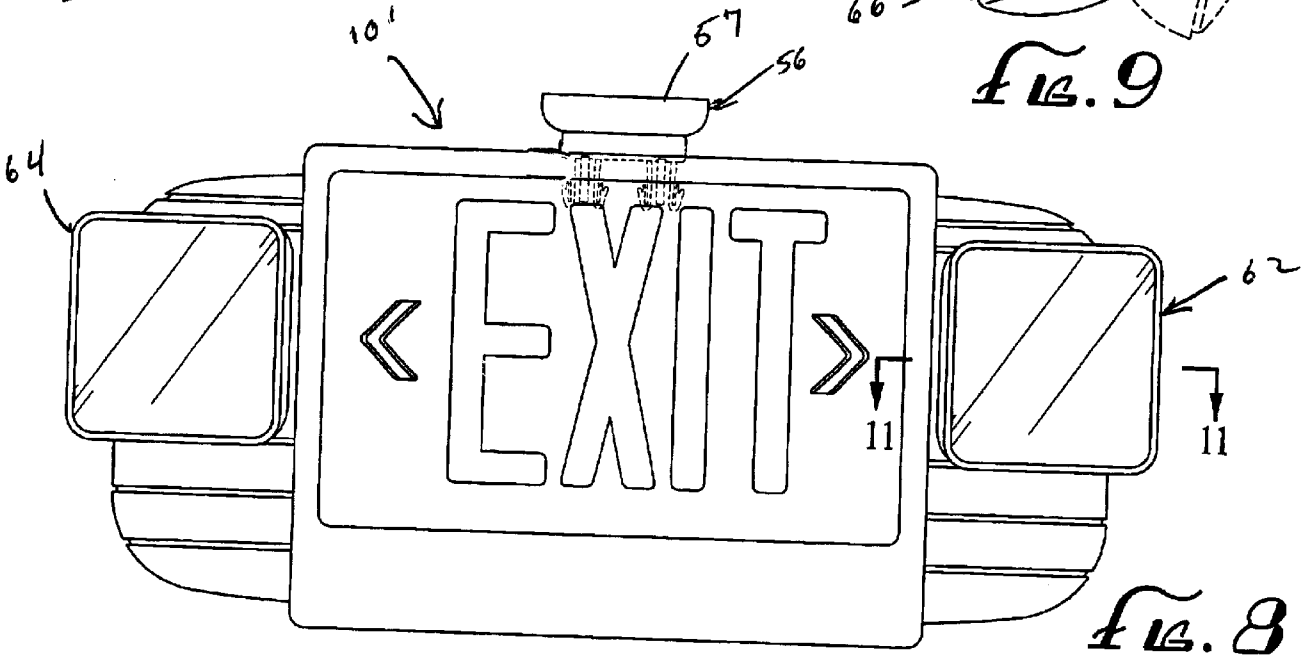
FIG. 8 is a front elevational view of a second embodiment of a low profile combination exit and emergency light system having a single piece body of the present invention, with rectangular emergency lights and including the connecting bracket shown in FIG. 7 secured in a top opening.
Figure 10:
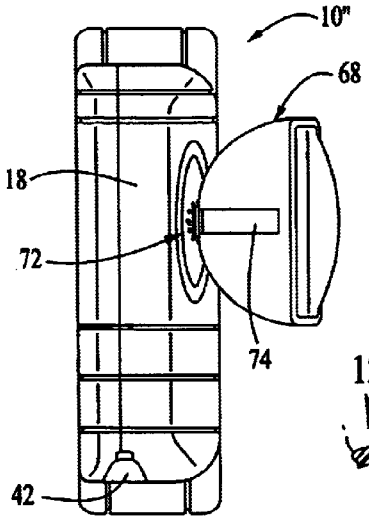
FIGS. 10–13 show various views of the special movable bases/holding portions for emergency lights, such as shown in FIG. 9.
Figure 11:
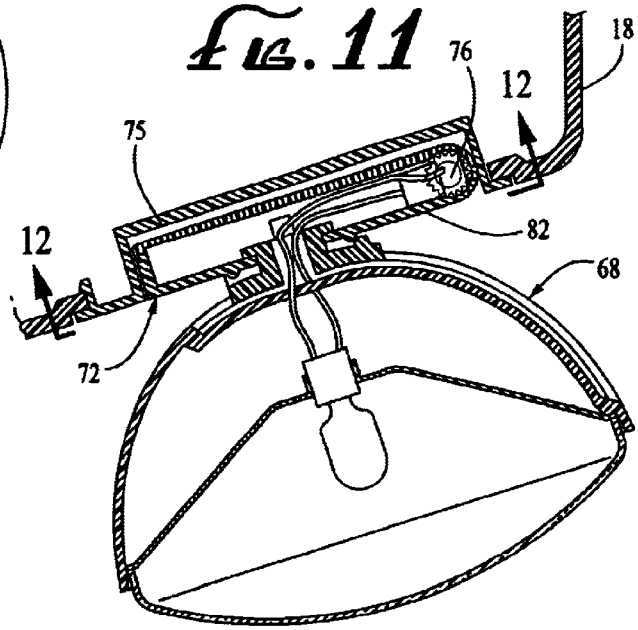
Figure 12:
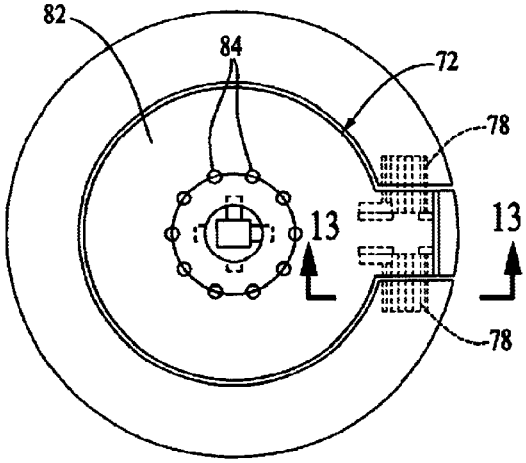
Figure 13:
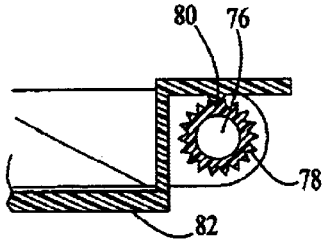

As shown in FIGS. 7, 8 and 9, the top surface of the central portion may be easily connected to an overhead electrical conduit by means of an adapter, bracket or connector 56 having a body 57 with a central opening 58 and a pair of resilient, locking leg portions 59, 60 for insertion into a top opening 61, after a plate or the like is removed there from.

The emergency lighting units 28, 30 may take a number of different configurations, and further embodiments thereof are described below.

For example, as shown at 62, 64 in the combo unit 10' in FIG. 8, the emergency lighting units may be rectangular in shape, as shown in the combo unit 10" illustrated in FIGS. 9–13 they may be extending circular or cylindrical units 66, 68. The emergency lighting units may have specialized bases 72 to enable extended movement thereof.

FIGS. 10–13 show one end of a combo unit, such as 10", having the base 72 therein. The bases for the lighting units at both ends would be identical and the description herein of base 72 applies equally to both lighting units, such as 66, 68. A slot 74 in the cylindrical unit 68 cooperates with the base 72, which base allows the unit to be rotated, turned or pivoted. In particular, the base 72 is pivotally held in a shallow dish-type portion 75 formed in end portion 18 around a pivot pin 76. The pivot pin 76 includes holding/ratcheting means, such as toothed wheels 78 that cooperate with extending pins or teeth 80 formed in an upper surface of a housing 82 of the base 72. The housing 82 and connected cylindrical lighting unit, such as 66, 68, can be rotated outwardly to the positions shown in broken line in FIG. 9 and held in position by the toothed wheels 78 and pins 80. Furthermore, the lighting units 66, 68 may be selectively and incrementally rotated within the bases 72, over knobs or raised portions 84 formed on the top surface of the bases, which cooperate with complementary knobs or raised portions on a lower portion of the lighting units.

It, therefore, can be seen that the present invention provides an improved low profile combination lighted exit sign and emergency lighting system held in a one piece body or housing having a pair of batteries, spaced apart to spread the weight thereof so as to obviate the need for extra support, and which includes a pair of downwardly shining end lights for added safety.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A combination lighted exit sign and emergency lighting system, comprising:

a one piece body having an enlarged central portion and a pair of smaller end portions fixedly secured to the enlarged central portion;

the enlarged central portion being hollow and containing a spaced apart pair of batteries electrically connected to a transformer and an LED lighting strip;

a front cover plate and a rear cover plate for the enlarged central portion, with indicia formed in at least the front cover;

a pair of emergency lights secured in the pair of smaller end portions and electrically connected to the pair of batteries; and a pair of downwardly pointing lights held in bottom portions of the pair of smaller end portions for shining light downwardly, away from a top surface toward a floor.

2. The combination lighted exit sign and emergency lighting system of claim 1 wherein the pair of emergency lights are movably held in bases secured in the pair of smaller end portions.

3. The combination lighted exit sign and emergency lighting system of claim 2 wherein the one piece body is substantially narrow and the pair of smaller end portions include separate rear covers removably attached thereto.

4. The combination lighted exit sign and emergency lighting system of claim 3 wherein the bases include pivoting means held in separate housings secured in shallow dish type portions formed in the pair of smaller end portions.

5. The combination lighted exit sign and emergency lighting system of claim 4 wherein the pair of emergency lights have a rectangular shape.

6. The combination lighted exit sign and emergency lighting system of claim 4 wherein the pair of emergency lights are circular in cross-section.

7. A combination lighted exit sign and emergency lighting system, comprising:

a one piece substantially narrow body having an enlarged central portion and a pair of smaller end portions integrally and fixedly formed with the enlarged central portion;

the enlarged central portion having a hollow chamber formed therein containing a pair of spaced apart batteries supported adjacent the pair of smaller end portions and electrically connected to a transformer and a single LED lighting strip;

a front cover plate and a rear cover plate removably attached to the enlarged central portion, with indicia formed in at least the front plate;

a pair of emergency lights secured in the pair of smaller end portions and electrically connected to the pair of spaced apart batteries; and a pair of downwardly pointing lights held in bottom portions of the pair of smaller end portions for shining light downwardly, away from a top surface toward a doorway.

8. The combination lighted exit sign and emergency lighting system of claim 7 wherein the pair of emergency lights are movably held in bases removably secured in the pair of smaller end portions.

9. The combination lighted exit sign and emergency lighting system of claim 8 wherein the pair of emergency lights have a rectangular shape.

10. The combination lighted exit sign and emergency lighting system of claim 9 wherein the pair of smaller end portions include separate rear covers removably attached thereto and the bases include pivoting means held in separate housings secured in shallow dish type portions formed in the pair of smaller end portions.

11. The combination lighted exit sign and emergency lighting system of claim 10 wherein the pair of emergency lights are circular in cross section and include guide means held in slots formed in the bases.

12. The combination lighted exit sign and emergency lighting system of claim 7 wherein the bases include pivoting means held in separate housings secured in shallow dish type portions formed in the pair of smaller end portions and the pivoting means includes a pair of toothed wheels.

13. A combination lighted exit sign and emergency lighting system, comprising:

a one piece substantially narrow body having an enlarged substantially rectangular shaped central portion and a pair of smaller end portions integrally and fixedly formed with the enlarged rectangular shaped central portion;

the enlarged rectangular shaped central portion having a hollow chamber formed therein containing a pair of spaced apart batteries supported adjacent the pair of smaller end portions and electrically connected to a transformer and a single LED lighting strip having a plurality of lamps therein;

a substantially rectangular shaped front cover plate and a substantially rectangular shaped rear cover plate removably attached to the enlarged substantially rectangular shaped central portion, with indicia formed in at least the front cover plate;

a pair of circular shaped emergency lights secured in the pair of smaller end portions and electrically connected to the pair of spaced apart batteries; the pair of circular shaped emergency lights being movably held in bases removably secured in the pair of smaller end portions; and a pair of downwardly pointing lights held in bottom portions of the pair of smaller end portions for shining light downwardly, away from a top surface toward a doorway.

14. The combination lighted exit sign and emergency lighting system of claim 13 wherein the pair of downwardly pointing lights are intense enough to shine through haze or smoke to light a doorway.

15. The combination lighted exit sign and emergency lighting system of claim 13 wherein the one piece substantially narrow body substantially eliminates light leakage from the body.

* * * * *